US005816619A

United States Patent [19]

Schaede

[11] Patent Number: 5,816,619

[45] Date of Patent: Oct. 6, 1998

[54] PROCESS FOR THE PRODUCTION OF DOCUMENTS WITH A SECURITY FEATURE IN THE FORM OF A FOIL COMPONENT AND DOCUMENT WITH SUCH A SECURITY FEATURE

[75] Inventor: Johannes Georg Schaede, Wuerzburg, Germany

[73] Assignee: De La Rue Giori S.A., Switzerland

[21] Appl. No.: 709,279

[22] Filed: Sep. 6, 1996

[30] Foreign Application Priority Data

Oct. 12, 1995 [CH] Switzerland ..... 2 886/95

[51] Int. Cl.[6] ..... B42D 15/00

[52] U.S. Cl. ..... 283/67; 283/86

[58] Field of Search ..... 283/91, 904, 902, 283/67, 70, 86, 72; 235/375, 432, 462; 359/1

[56] References Cited

U.S. PATENT DOCUMENTS

| | | | |
|---|---|---|---|
| 3,556,563 | 1/1971 | Scheinberg | 283/67 |
| 3,647,275 | 3/1972 | Ward | 283/86 |
| 3,668,795 | 6/1972 | Barker . | |
| 4,171,864 | 10/1979 | Jung et al. | 283/86 |
| 4,269,473 | 5/1981 | Flothmann et al. | 283/86 |
| 4,732,410 | 3/1988 | Holbein et al. | 283/67 |
| 5,107,100 | 4/1992 | Shephard et al. | 235/472 |
| 5,421,619 | 6/1995 | Dyball | 283/86 |

FOREIGN PATENT DOCUMENTS

| | | |
|---|---|---|
| 44 10 431 A1 | 9/1995 | Germany . |
| WO 94/11203 | 5/1994 | WIPO . |

*Primary Examiner*—Willmon Fridie, Jr.

*Attorney, Agent, or Firm*—Kane, Dalsimer, Sullivan, Kurucz, Levy, Eisele and Richard, LLP

[57] ABSTRACT

Each document (W1) is provided with a security feature in the form of a foil component (2) which is permanently attached to the document and cannot be changed without destroying it. Before the foil components are applied to the documents, they are provided with machine-readable image information which is variable from one foil component to another (3*a*, 4*a*). Once the foil component has been applied, the documents are passed through a reading device which reads the variable image information (3*a*, 4*a*) and controls a printer which applies a copy of this variable image information to the document outside the foil component. This can be in particular a combination of characters (7*a*) which is printed as part of a serial number (6*a*).

8 Claims, 1 Drawing Sheet

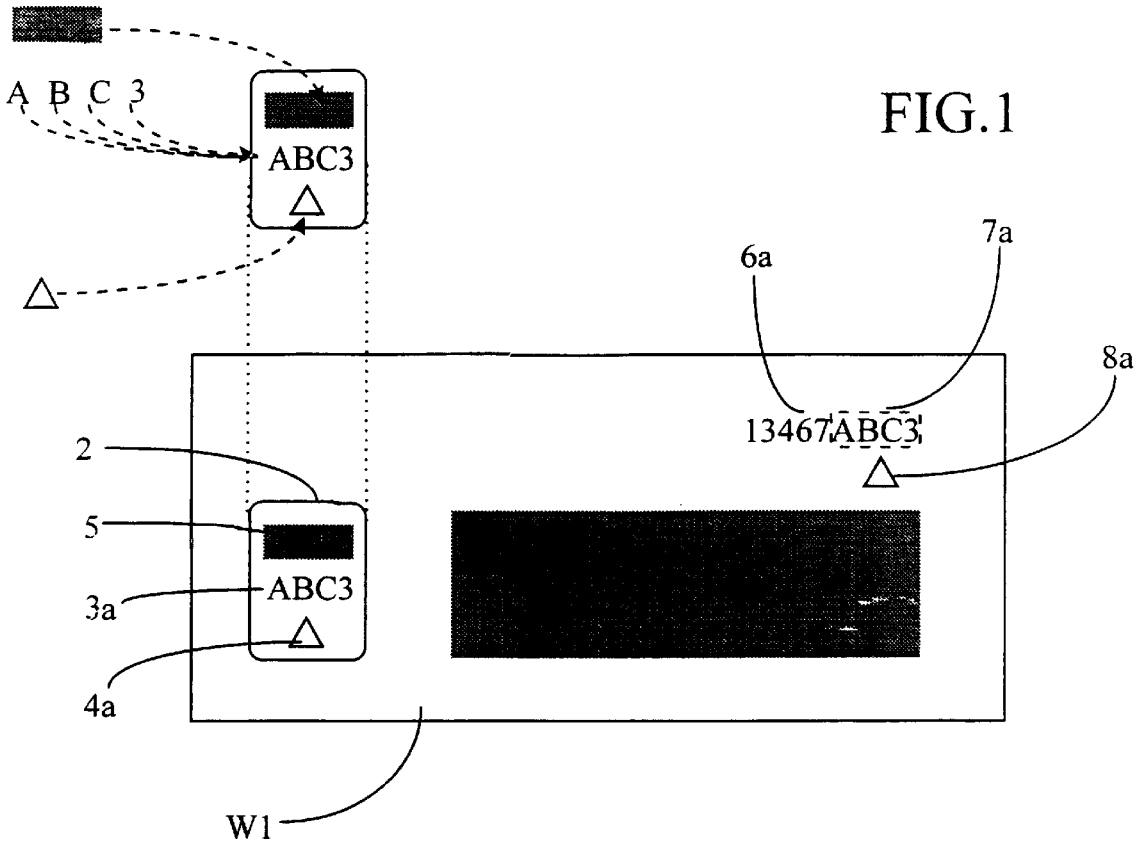
FIG.1
FIG.2
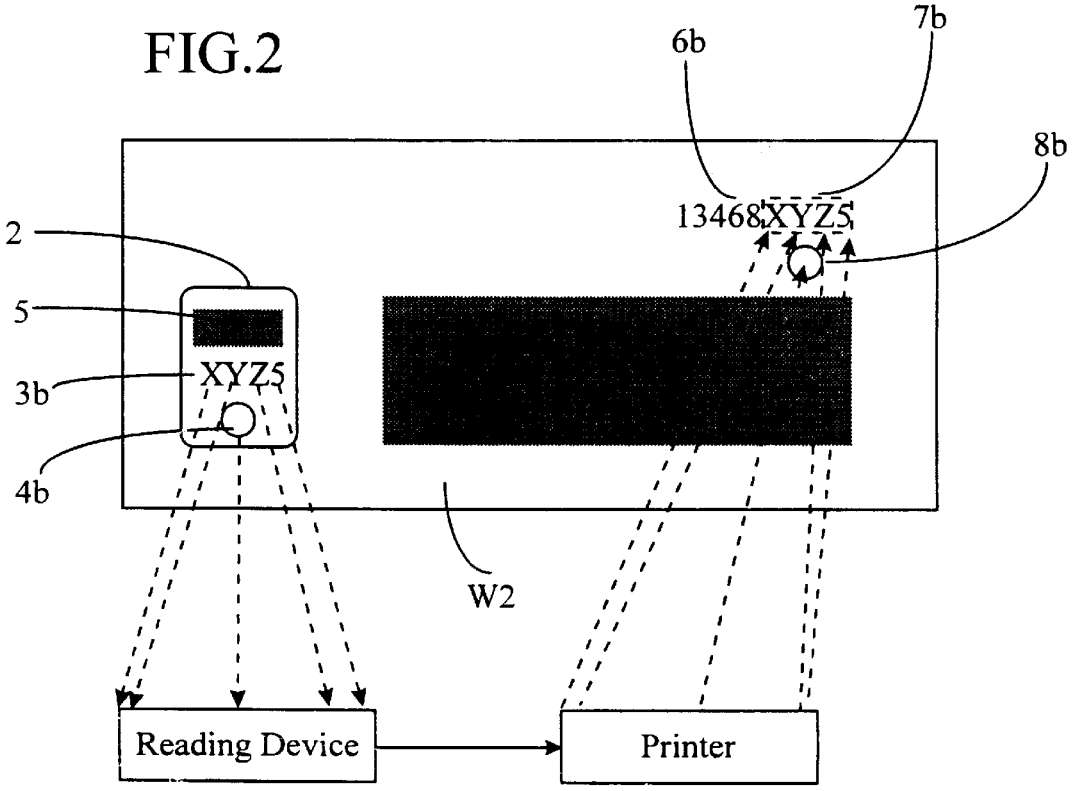

PROCESS FOR THE PRODUCTION OF DOCUMENTS WITH A SECURITY FEATURE IN THE FORM OF A FOIL COMPONENT AND DOCUMENT WITH SUCH A SECURITY FEATURE

FIELD OF THE INVENTION

The invention relates to a process for the production of documents, in particular securities or notes of value, with a security feature in the form of a foil component which is permanently attached to the document and cannot be changed without destroying it, and to a document, in particular a note of value with a security feature of this kind.

PRIOR ART

Documents of this kind in the form of notes of value are known for example from EP-A-0 625 466. According to it, to increase security against forgery pieces of film with optically variable images are stuck on the notes, these images being in particular holograms or cinegrams, which change their appearance depending on the angle from which they are viewed. Notes of this kind cannot be reproduced with colour copiers.

SUMMARY OF THE INVENTION

This invention is based on the task of further increasing the security of documents against forgery, above all bank notes, via the use of foil components, by creating an additional security feature which not only allows the individual registration of a document but also can be detected by any member of the general public without technical aids and which can be produced simply and reliably.

This function is according to the invention resolved by the features indicated in the characterising part of claim 1.

The variable image information contains preferably a combination of characters in the form of a sequence of letters and/or figures which for example can be placed on the notes as part of the serial number and can be reproduced to the same or to a different scale.

The foil component preferably contains not only the variable image information but also an unchanging part of the image, for example in the form of a hologram.

The variable image information read is applied to the documents preferably with a non-impact printer, in particular an inkjet printer.

A document in accordance with the invention is characterised by the fact that the foil component permanently attached to it has image information which is variable from one document to another and that the same image information is printed again, outside the foil component, on the document, as a copy to the same or a different scale.

BRIEF DESCRIPTION OF THE DRAW1NGS

The invention is more clearly explained by the drawing of one embodiment, namely notes or bills with a serial number. The illustrations show:

FIGS. 1 and 2, two different notes of value which were made by the process in accordance with the invention.

DESCRIPTION OF THE PREFERRED EMBODIMENT(S)

Each note of value W1, W2 has a normal serial number 6*a* or 6*b*, in the embodiment concerned the serial numbers 13467 and 13468, and has a foil component 2 permanently attached to it which cannot be changed without destroying it. These foil components 2 are applied for example by hot-embossing on the notes.

Before being applied to the notes, these foil components 2 are provided on the one hand with a machine-readable image information which is changed from one foil component to another, and on the other hand with an image section which is not changed and which is the same for all the foil components. In the embodiment concerned, the variable image information comprises a combination of characters 3*a* and 3*b* and a simple FIG. 4*a* and 4*b* for the notes W1 and W2, and the non-variable part of the image 5 comprises for example a hologram indicated only schematically, which thus is the same for all notes. In the embodiment concerned, the foil component 2 on note W1 has a combination of characters 3*a* comprising the sequence of characters ABC3 and as FIG. 4*a* a triangle, whereas the foil component 2 on note W2 has a combination of characters 3*b* comprising the sequence of characters XYZ5 and as FIG. 4*b* a circle.

Once the foil components 2 have been applied to the notes, the latter are passed through a reading device which reads the variable image information, thus the combination of characters 3*a* and 3*b* and FIGS. 4*a* and 4*b*. This variable image information is then applied to the relevant note outside the foil component 2 via a printer controlled by the reading device, and in the embodiment concerned the combination of characters read 3*a* and 3*b* is placed at the end of the serial numbers 6*a* and 6*b* as copies 7*a* and 7*b*, so that this combination of characters forms for the observer part of the serial number. At the same time, the FIGS. 4*a* and 4*b* read on foil components 2 are placed underneath the serial numbers as figure copies 8*a* and 8*b*. This variable image information is applied to the notes, preferably with a non-impact printer, in particular an inkjet printer, whereby this reproduction can be to the same or, as shown for copies 8*a* and 8*b*, a different scale.

The invention is not limited to the embodiment described, but allows for many variations with regard to the variable image information, which can be any sequence of numbers and/or letters and/or a variable figure, for example a variable interference figure, and with regard to the place where this image information is reproduced on the note of value. In addition, of course, variable information in the form of an additional figure does not have to be present. Also, any suitable known printing process can be used to make the variable image information, whereby after each individual print, a change to the image information takes place for the subsequent print.

What is claimed is:

1. Process for the production of documents (W1, W2) with a security feature in the form of a foil component (2), which is permanently attached to the document and cannot be changed without being destroyed, characterised by the following steps: giving the foil component (2) visible machine-readable image information which varies from one foil component to another (3*a*, 4*a*; 3*b*, 4*b*) and a non-variable image section (5), applying said foil component (2) to the document (W1, W2) passing the documents (W1, W2) through a reading device once the foil component (2) has been applied, and applying via a printer controlled by said reading device a copy (7*a*, 7*b*; 8*a*, 8*b*) of said visible variable image information to the document outside the foil component (2).

2. Document according to claim 1, characterised by the fact that the variable image information contains a combination of characters (3*a*, 3*b*), in particular a sequence of letters and/or figures.

3. Document according to claim 2, characterised by the fact that the combination of characters read (3*a*, 3*b*) is applied as part of a serial number (6*a*, 6*b*) to the document, preferably a note of value.

4. Document according to claim 1, characterised by the fact that the variable image information also contains a figure (4*a*, 4*b*).

5. Process according to claim 1, characterised by the fact that said copy (7*a*, 7*b*; 8*a*, 8*b*) of the variable image information is applied to the same or to a different scale.

6. Process according to claim 1, characterised by the fact that the printer used is a non-impact printer, such as an inkjet printer.

7. Document with a security feature in the form of a foil component (2) which is permanently attached to the document and cannot be changed without being destroyed, characterised by the fact that the foil component (2) comprises visible machine-readable image information (3*a*, 4*a*; 3*b*, 4*b*) which is variable from one document to another (W1, W2) and also a non-variable image section (5) and that said variable image information is printed on the document again outside the foil component (2), this being in the form of a copy (7*a*, 8*a*; 7*b*, 8*b*) to the same or to a different scale.

8. Document according to claim 7, characterised by the fact that said non-variable image section is in the form of a hologram.

* * * * *